United States Patent [19]

Stahlecker et al.

[11] Patent Number: 4,667,464

[45] Date of Patent: May 26, 1987

[54] BEARING AND DRIVING ARRANGEMENT FOR A SPINNING ROTOR OF AN OPEN-END SPINNING MACHINE

[75] Inventors: Fritz Stahlecker, Josef-Neidhart-Strasse 18, 7347 Bad Überkingen; Wolfgang Feuchter, Deggingen-Reichenbach; Dieter Götz, Geislingen; Friedbert Schmid, Bad Überkingen; Werner Zott, Donzdorf, all of Fed. Rep. of Germany

[73] Assignees: Hans Stahlecker; Fritz Stahlecker, both of Fed. Rep. of Germany

[21] Appl. No.: 627,559

[22] Filed: Jul. 3, 1984

[30] Foreign Application Priority Data

Jul. 5, 1983 [DE] Fed. Rep. of Germany ..... 3324129

[51] Int. Cl.[4] ..... D01H 1/24; D01H 1/12

[52] U.S. Cl. ..... 57/406; 57/92; 57/104

[58] Field of Search ..... 57/400, 401, 404, 406, 57/104, 103, 92

[56] References Cited

U.S. PATENT DOCUMENTS

| | | | |
|---|---|---|---|
| 3,877,212 | 4/1975 | Canzler | 57/406 X |
| 4,041,688 | 8/1977 | Stahlecker | 57/406 X |
| 4,070,814 | 1/1978 | Goldammer et al. | 57/406 X |
| 4,098,065 | 7/1978 | Stahlecker et al. | 57/406 |
| 4,149,365 | 4/1979 | Kobayashi et al. | 57/406 X |
| 4,183,199 | 1/1980 | Schumann | 57/406 X |

FOREIGN PATENT DOCUMENTS

| | | | |
|---|---|---|---|
| 1901453 | 1/1969 | Fed. Rep. of Germany . | |
| 2206237 | 2/1972 | Fed. Rep. of Germany . | |
| 2206264 | 8/1973 | Fed. Rep. of Germany | 57/103 |
| 2206238 | 8/1975 | Fed. Rep. of Germany | 57/103 |
| 2801693 | 1/1978 | Fed. Rep. of Germany . | |

*Primary Examiner*—Donald Watkins

*Attorney, Agent, or Firm*—Barnes & Thornburg

[57] ABSTRACT

A bearing and driving assembly is disclosed for an open end spinning rotor at a spinning unit of the type having a rotor mounted on a rotor shaft, a twin disk bearing arrangement for rotatably supporting the rotor shaft and a tangential belt drivingly engaging the rotor shaft of the radial side thereof opposite the twin dusk arrangement. To minimize failures of such a system caused by resonant system vibrations and to facilitate high spinning speeds with minimal manufacturing expenses, the assembly is designed so that the system critical velocity where excessive resonant vibrations may occur is substantially lower than spinning operational speeds.

7 Claims, 3 Drawing Figures

BEARING AND DRIVING ARRANGEMENT FOR A SPINNING ROTOR OF AN OPEN-END SPINNING MACHINE

BACKGROUND AND SUMMARY OF THE INVENTION

The invention relates to a bearing and driving arrangement for a spinning rotor of an open-end spinning unit including a rotor and a shaft manufactured from steel or the like, which shaft is rotatably carried in a wedge gap formed by pairs of supporting disks having rotor shaft engaging fittings made out of plastic. The rotor shaft is driven by a tangential belt drivingly engageable with the rotor shaft between the pair of supporting disks, the tangential belt being pressed against the shaft.

Bearings and driving arrangements of the above noted kind are disclosed in German Patent (DE-PA) No. 19 01 453 which are suitable for very high rotational speeds of spinning rotors, because it is not the very fast rotating shaft of the spinning rotor that is directly, rotatably supported, but rather the axles of the supporting disks, driven with essentially lower rotational speeds, are directly rotatably supported by roller bearings or the like. Such a bearing and driving arrangement is a very complex dynamic system, because the supporting disks are provided with a spring-like elastic fitting which supports the rotor shaft and also because the tangential belt is elastically or resiliently pressed against the rotor shaft. It is further noted with these type of arrangements that compilations of fiber material and/or impurities within the spinning rotor can occur to eccentrically load the system with respect to the rotating axles/rotating axes of the rotating parts. With bearing arrangements of this type being used in practice at rotor speeds up to 80,000 revolution per minute (RPM), a corresponding high strength/size of the rotor shaft is therefore provided so that the rotational speed is clearly beneath the critical rotational speed (rotational speed inducing harmful resonant harmonic vibrations) of the system. Further, the critical system rotational speed itself is very difficult to determine and it may change incidentally during operation by a fiber material accumulation within the spinning rotor during spinning operations.

Currently, in the rotor spinning industry, rotor speeds of 100,000 RPM are desired which even further increase the indicated problems. Thereby a stronger dimensioning, especially of the rotor shaft, leads not only to a correspondingly greater dimensioning of the supporting disks and the bearings resulting in an increase in material expense, these heavier constructions also lead to a disproportionately greater increase in energy consumption for the operation of the spinning machines.

It is an object of the present invention to provide a bearing and driving arrangement of the type mentioned above which will facilitate operation with a spinning rotor having rotational speeds of 100,000 RPM and more without necessitating an increase in material expense and without disproportionately high energy consumption expenses.

The invention involves the recognition that it is possible to design and operate the spinning unit so that the rotational speed of the spinning rotor is safely above the critical system rotational speed. With the system measurements and arrangements constructed according to preferred embodiments of the invention, it is provided that the critical system rotational speed is so low that the high operational rotational velocity remains sufficiently higher so that even any changes eventually occurring during operation, such as an irregular or nonsymmetric deposition of fiber material and accumulation of particle impurities in the rotor do not lead to the danger that resonance phenomena occurs which could lead to a destruction of the rotor and/or the supporting disks.

In preferred embodiments of the invention, the object of attaining a system with a critical system rotational speed sufficiently lower than the high operational speeds (80,000 RPM and greater for the rotor shaft) can be achieved utilizing system parameters along the following lines:

- rotor weight—less than 70 g (grams)
- rotor inside diameter at fiber collecting groove—30–40 mm (millimeter)
- rotor shaft diameter—maximum of 8 mm
- distance between supported disk pairs—70–100 mm
- distance between rotor center of gravity and closest pair of supporting disks—25–35 mm.
- tangential belt pressure on the rotor shaft—20–30 N (Newtons)

An especially advantageous practical preferred embodiment of the invention provides that the rotor is lighter than 70 g (grams), the rotor has a mizimum inside diameter at the collection groove of 36 mm (millimeters), the rotor shaft has a maximum diameter of 8 mm (millimeters), the distance between the pairs of supporting disks is between 80 and 90 mm, the distance between the center of gravity of the rotor and the pair of supporting disks facing the same is approximately about 30 mm, and the pressure or compression force for the tangential belt against the rotor shaft is approximately 25 N (Newtons).

In preferred embodiments of the invention, it is also provided that the distance from the center of the tangential belt to the pair of supporting disks facing (closest to) the rotor is between 25 and 40 percent, preferably about one third of the distance between the pairs of supporting disks themselves. This way the introduction of the pressure or compression force of the tangential belt which is seen as the main cause for a vibration, is so arranged that the danger of sympathetic vibration phenomena is further decreased.

In order to avoid that the running or bearing surfaces of the supporting disks are heated with an increased rotational speed in an inadmissible manner, a further arrangement of the preferred embodiments of the invention provides that the running surfaces of at least the supporting disks of the pair facing the rotor are arranged with a circumferential ring groove. The service life for the fittings of the support disks can thereby essentially be improved, even with high rotational speeds.

In a further feature of preferred embodiments of the invention, it is provided that the shaft of the spinning rotor includes ring bands in the area of the pairs of the supporting disks. Thereby, the position of the rotor with respect to its locations relative to the other operational elements, especially a fiber feed channel and a yarn withdrawal channel of a spinning unit utilizing the system, is dependent upon the diameter of the rotor shaft, so that spinning rotor having a thinner shaft may also be inserted into bearings which are originally designed for a larger dimensioned shaft.

Further objects, features, and advantages of the present invention will become more apparent from the following description when taken with the accompanying drawings which show, for purposes of illustration only, an embodiment in accordance with the present invention.

DETAILED DESCRIPTION OF THE DRAWINGS

Figure 1:
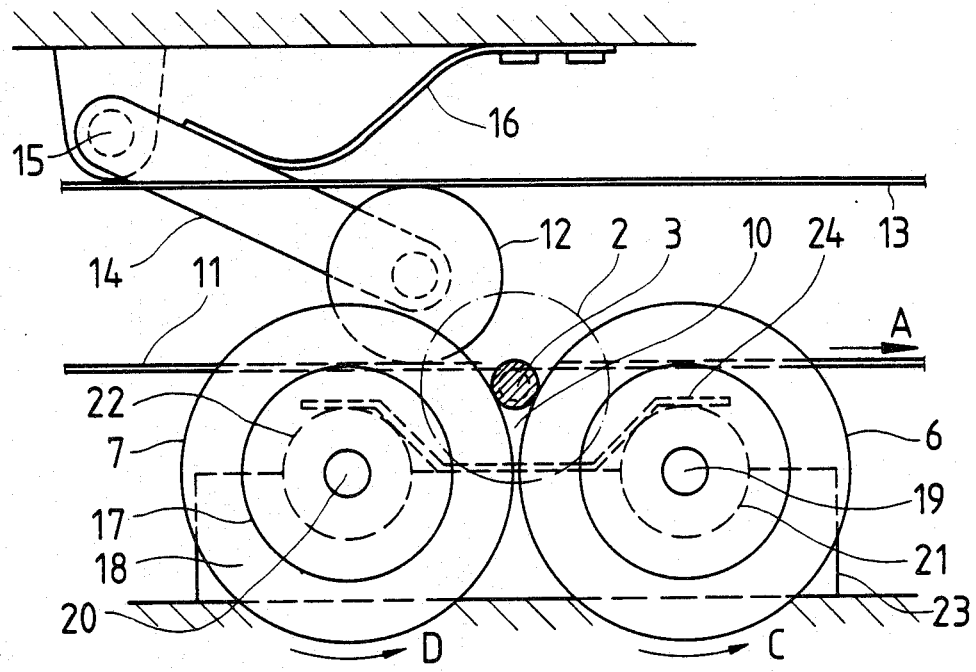
FIG. 1 is a front schematic view through a spinning rotor bearing and driving arrangement constructed in accordance with a preferred embodiment of the present invention, with a cross-sectional showing of the shaft of a spinning rotor indicated by dotted lines.
Figure 2:
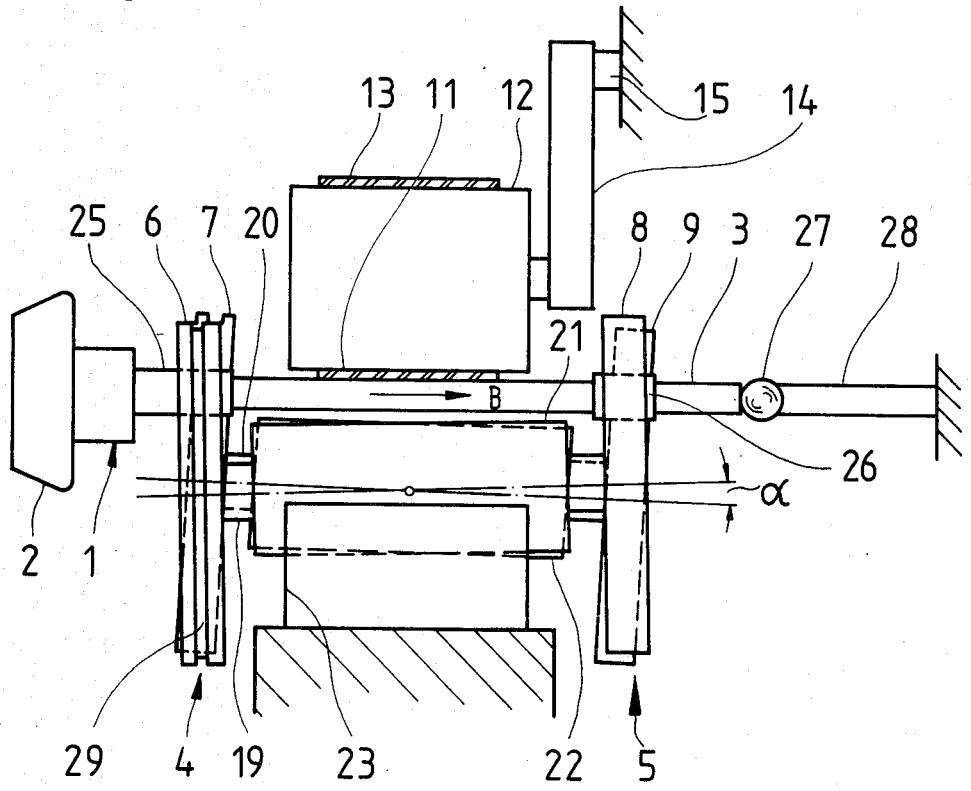
FIG. 2 is a side schematic view of the spinning rotor bearing and driving arrangement according to FIG. 1, taken opposite the operational direction of a tangential belt driving the rotor shaft.

In the drawings and the following description, like reference characters are used throughout the various views to designate like structures.

In order not to obscure the present invention, the drawings and the following descriptions only include those parts of a rotor spinning machine as are deemed necessary for one skilled in the art to practice the invention. For example, it will be understood by one skilled in the art of rotor spinning that a complete rotor spinning machine would include a plurality of spinning units arranged adjacent one another and each having a spinning rotor and bearing assembly with certain common driving elements such as the tangential belt described below.

The spinning rotor 1 of the illustrated embodiment includes a rotor 2 supported oh a rotor shaft 3. The rotor 2, which is pressed upon shaft 3 by means of a ring band, exhibits a hollow space known in the art for accommodating spinning of fibers into yarn and which space proximately corresponds to the outer contour of the rotor, whereby the greatest inner diameter is formed by a fiber collecting groove connecting with a fiber slide wall.

The shaft 3 of the spinning rotor 1 is disposed in the wedge gap formed by two pairs of supporting disks 4 and 5, which each includes two supporting disks 6, 7 and 8, 9. The supporting disks 6, 7, 8 and 9 include respectively a metallic disk-shaped base body 17 having a fitting 18, i.e., a plastic ring, the circumferential surface of which ring forms the respective running surface for shaft 3. The base body 17 of the supporting disks 6, 8 and 7, 9 which respectively are arranged at one side of shaft 3, include axles 19 and 20 which are borne in bearing housings 21 and 22 by means of roller bearings. The bearing housings 21 and 22 are inserted into a common bearing seat or block 23 in shell-like receptacles in which they are secured by means of holders 24 formed as spring clamps.

Figure 3:
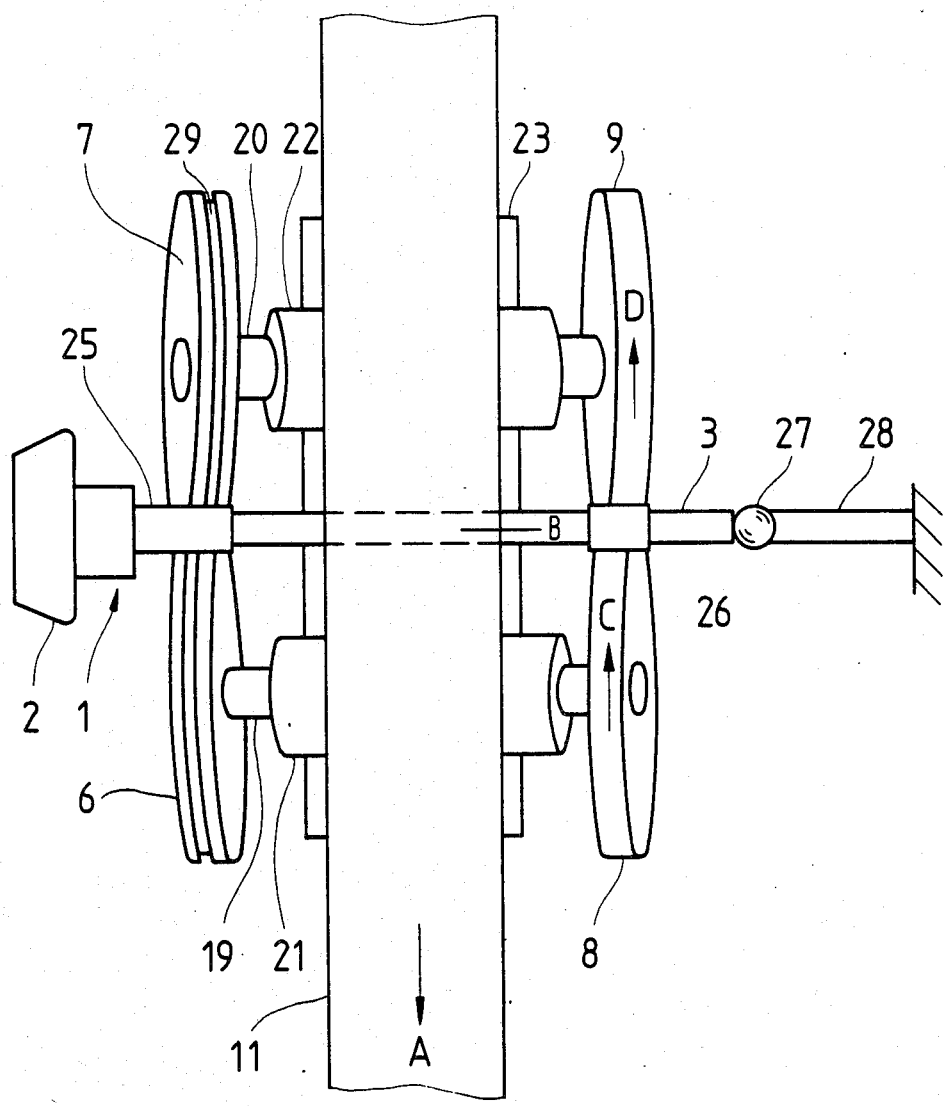
FIG. 3 is a top view of the spinning rotor bearing and driving arrangement according to FIGS. 1 and 2, wherein the pressure roller charging the tangential belt is not shown.

Axles 19 and 20 of the supporting disks 6, 8 and 7, 9 extend in planes (as seen in the top view according to FIG. 3) parallel to each other. They are set against each other in an angle having a size about one degree in vertical direction to this plane, whereby the cross-axle is approximately centered between the supporting disks 6, 8 and 7, 9. The offset angle $\alpha$ is worked into the shell-like receptacles of the bearing block 23.

The rotor shaft 3 is driven directly by a run 11 of a tangential belt which secures the shaft 3 within the wedge gap of the pairs of supporting disks 4 and 5. The run 11 of the tangential belt is loaded with supporting roller 12 which is arranged in operational direction A of the run 11 closely in front of the shaft 3 (FIG. 1). The return run 13 of the tangential belt is guidable at the top of pressure roller 12. The pressure roller 12 is pivotably supported upon a swivel arm 14 for movement about an axle 15 and is freely rotatable, the arm 14 being resiliently forced in the direction toward the belt run 11 by means of a spring 16.

Via the offsetting of axles 19 and 20 in connection with the operational direction A of run 11 of the tangential belt, and the rotational directions C and D of the supporting disks, a transverse force in the direction of Arrow B is applied upon shaft 3 of the spinning rotor 1. Said transverse force is directed via the rotor shaft to a step bearing roller 27 which is supported against this transverse force by means of a spring-like bolt 28.

In order to operate the spinning rotor 1 with high rotational speeds in the range 100,000 RPM and more and without reaching the critical system rotational speed, the rotor shaft bearing and driving assembly is so arranged even with eccentrical deposition of fibers within the rotor during operation, that the critical rotational speed of the system is clearly below the spinning operational speeds. This is obtained according to a preferred embodiment by providing the following measurements in an especially preferred practical embodiment:

- the rotor 2 has a weight of less than 70 g (grams) and an inner diameter of 36 mm (millimeters) in the area of the fiber collecting groove;
- the rotor shaft 3 has a diameter of no more than 8 mm;
- the distance between the pairs of supporting disks 4 and 5—of supporting disks 6 and 8 as well as 9 and 7 respectively seen in the direction of rotor shaft 3—is between 80 and 90 mm;
- the center of gravity of rotor 2 is at a distance of about 30 mm from the pair of support disks 4 facing and closest to the rotor, and
- the pressure force applied by spring 16 and transferred by the pressure roller 12 to run 11 of the tangential belt upon rotor shaft 3, amounts to 25 N (Newtons).

It has further proven advantageous according to the invention to provide that run 11 of the tangential belt does not quite run centered between the supporting disk pairs 4 and 5 but is arranged closer to the pair of support disks 4 facing the rotor 2. The preferred distance between the pair of support disks 4 and the center of the run 11 is slightly less than one-third of the distance between the two pairs of supporting disks 4 and 5.

It has also been proven advantageous according to the invention to provide that the width of the surfaces of the supporting disks 6, 7, 8 and 9 are slightly wider than the diameter of the shaft 3, preferably the difference in the size being between 10 to 20 percent.

In order to avoid a heat build-up in the fittings 18 of supporting disks 6 and 7 of pair 4 which is exposed in operation to much higher stress than the pair of supporting disks 5, centered ring grooves 29 are provided in the track surface of fittings 18 of these supporting disks 6 and 7 respectively.

In practice, it is sufficient if the rotor shaft 3, especially in the area between the two pairs of supporting disks 4 and 5, exhibit a smaller diameter of less than 8 mm. As it is shown in the illustrated embodiment, thickened ring bands 25 and 26 are provided in the area of the pairs of the supporting disks 4 and 5 which run on the mounting 18 of the supporting disks 6 to 9. Further arrangements are also contemplated in the invention wherein the ring band 25 is drawn in front to the area of the ring band of rotor 2, which means that rotor 2 is pressed upon the extending ring band 25 with a corresponding bore.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Disk for a bearing assembly of spinning rotors of the type having four disks arranged in two pairs forming a wedge-shaped gap for supporting a shaft of said spinning rotor, wherein the circumferential surface of said disk is provided with a ring groove for minimizing heat build up during use.

2. Disk according to claim 1, wherein said disk has a metallic disk-shaped body and a ring-shaped fitting made from plastic material disposed around the circumference of the disk-shaped body to be directly supportingly engageable with a spinning rotor shaft during use, and wherein said ring groove is provided in said fitting.

3. A supporting disk arrangement for a bearing assembly for an opem-end spinning rotor shaft of the type including four disks arranged in two pairs to form a wedge-shaped support gap for the spinning rotor shaft, including at least one disk exhibiting a disk-shaped metallic body and a ring-shaped fitting made from plastic material, said fitting being disposed around the circumference of the disk-shaped metallic body, said plastic material being dispsed at the outer running surface of the disk which supportably engages the spinning rotor shaft when in an in-use position.

4. An arrangement according to claim 3, wherein each of said disks exhibit a corresponding plastic material ring-shaped fitting disposed around the circumference of the disk-shaped metallic body.

5. An arrangement according to claim 3, wherein the at least one disk includes a ring groove around the circumference of the ring-shaped fitting for minimizing heat build up during use.

6. An arrangement according to claim 4, wherein at least two of said disks include respective ring grooves around the circumference of the ring-shaped fittings for minimizing heat build up during use.

7. An arrangement according to claim 6, wherein said disks with the ring grooves are disposed closest to the rotor when in an in use position on a spinning machine.

* * * * *

Disclaimer 4,667,464—Fritz Stahlecker, Bad Uberkingen; Wolfgang Feuchter, Deggingen-Reichenbach; Dieter Gotz, Geislingen; Friedbert Schmid, Bad Uberkingen; Werner Zott, Donzdorf, all of Fed. Rep. of Germany. Patent dated May 26, 1987. Disclaimer filed Jan. 24, 1997, by the assignee, Hans Stahlecker and Fritz Stahlecker.

Hereby enters this disclaimer to claims 3 and 4 of said patent.

*(Official Gazette,* June 17, 1997)